US005275363A

United States Patent [19]

Dennis

[11] Patent Number: 5,275,363

[45] Date of Patent: Jan. 4, 1994

[54] DENNIS BAG HOLDER

[76] Inventor: Ralph E. Dennis, 2617 Fishinger Rd., Columbus, Ohio 43221

[21] Appl. No.: 858,734

[22] Filed: Mar. 27, 1992

[51] Int. Cl.[5] ..... B65B 67/00

[52] U.S. Cl. ..... 248/101; 248/214; 248/312.1; 248/224.3

[58] Field of Search ..... 248/101, 99, 95, 97, 248/224.3, 224.4, 220.4, 312.1, 214; 141/314, 390, 391, 114; 220/630; 383/33, 12

[56] References Cited

U.S. PATENT DOCUMENTS

| | | | |
|---|---|---|---|
| 457,086 | 8/1891 | Ketchum | 248/97 X |
| 1,019,366 | 3/1912 | Sargent | 248/101 |
| 2,235,182 | 3/1941 | Weston | 248/100 |
| 2,483,844 | 10/1949 | Ranseen | 248/99 |
| 2,903,215 | 9/1959 | Metcalf | 248/99 |
| 4,478,332 | 10/1984 | Wiestmiller | 383/12 X |
| 4,768,742 | 9/1988 | Kaaloa | 248/100 X |
| 4,838,504 | 6/1989 | Bittenbinder | 248/100 |
| 4,974,798 | 12/1990 | Harding et al. | 248/224.3 X |
| 4,979,706 | 12/1990 | Feldman et al. | 248/101 |

*Primary Examiner*—Karen J. Chotkowski
*Attorney, Agent, or Firm*—John L. Gray

[57] ABSTRACT

Applicant's invention provides a bag holder which enables a ZIPLOC® type of bag to be held in open position while filling and is adaptable to various sizes of these bags and which invention can be readily used by a single individual.

9 Claims, 2 Drawing Sheets

FIG. 1
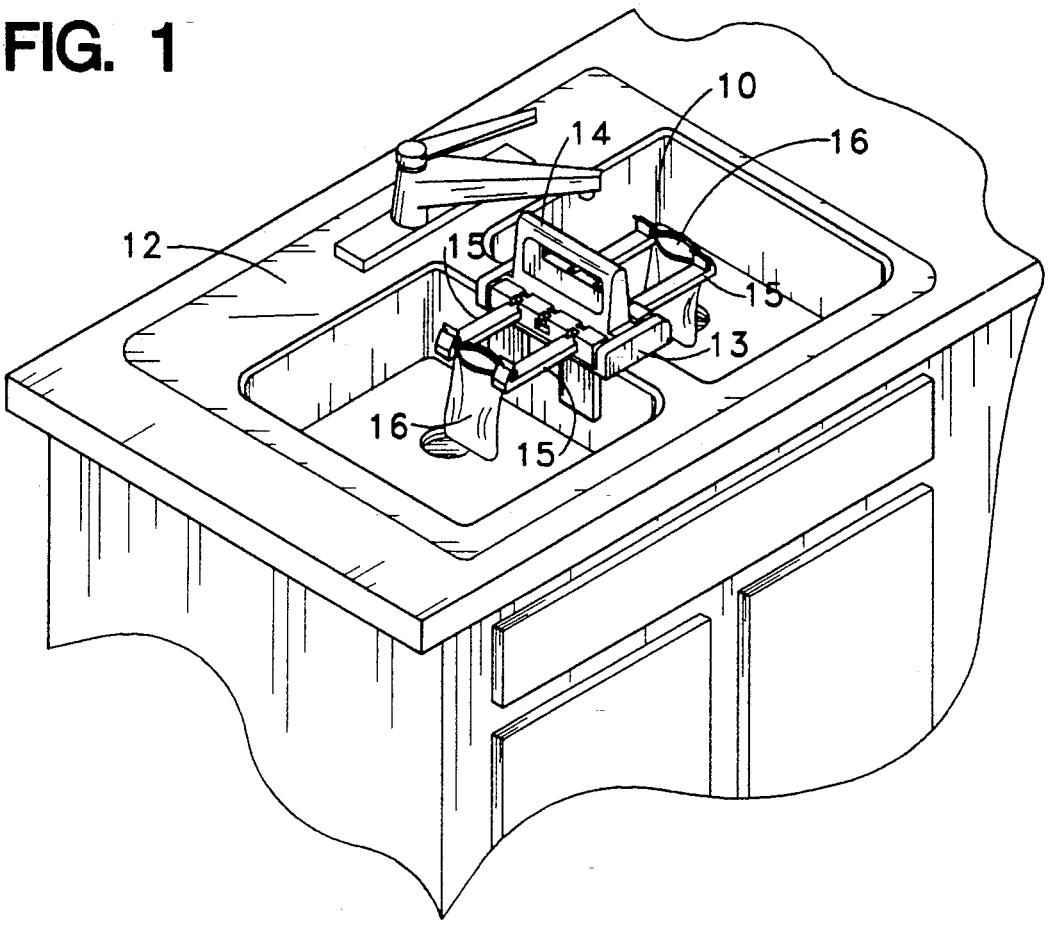
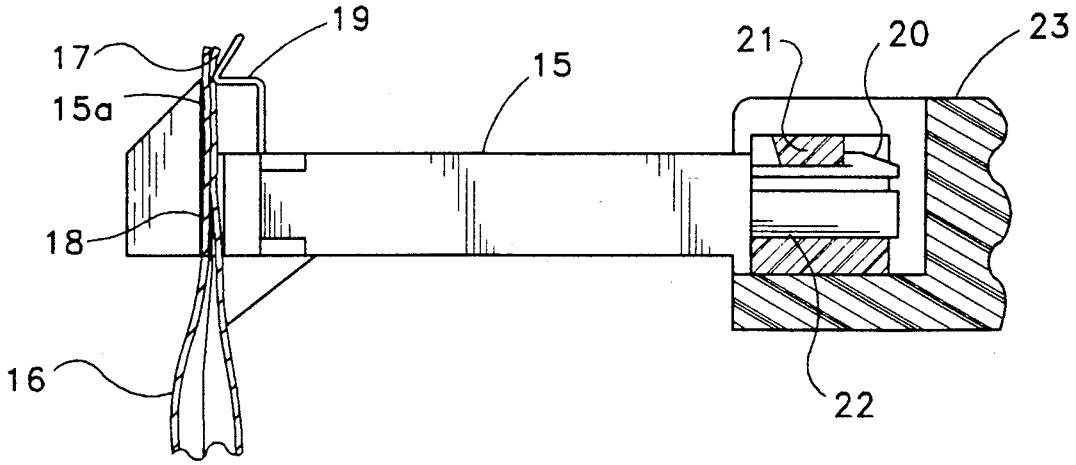
FIG. 2

DENNIS BAG HOLDER

BACKGROUND OF THE INVENTION

So-called ZIPLOC® type of plastic bags are used for a variety of household food storage purposes. Such bags are characterized in that they are thicker in cross section where the closing locking portion is present at the mouth of the bag and that these bags come in a variety of widths and lengths. In filling such bags with materials, such as food, hardware, etc., many times a second person is required to be present to hold the bag in an open position so that the material may be inserted therein. This, of course, results in a waste of time and manpower in performing what should be a single individual's task.

SUMMARY OF THE INVENTION

Applicant has solved this problem by providing a bag holder which enables a ZIPLOC® type of bag to be held in open position while filling.

Applicant's invention is adaptable to various sizes of these bags and can be readily used by a single individual.

It is therefore an object of this invention to provide a holder adapted to hold bags of the ZIPLOC® type in an open position for filling.

It is a further object of this invention to provide such a device which may accommodate a variety of lengths of such bag and also a variety of widths of such bag.

These, together with other objects and advantages of the invention will become more readily apparent to those skilled in the art when the following general statements and descriptions are read in the light of the appended drawings.

BRIEF DESCRIPTION OF THE DRAWINGS

FIG. 1 is a perspective view of applicant's preferred embodiment of this invention.

FIG. 2 is a sectional view along the plane 2—2 of FIG. 1.

DETAILED DESCRIPTION OF THE INVENTION

Figure 3:
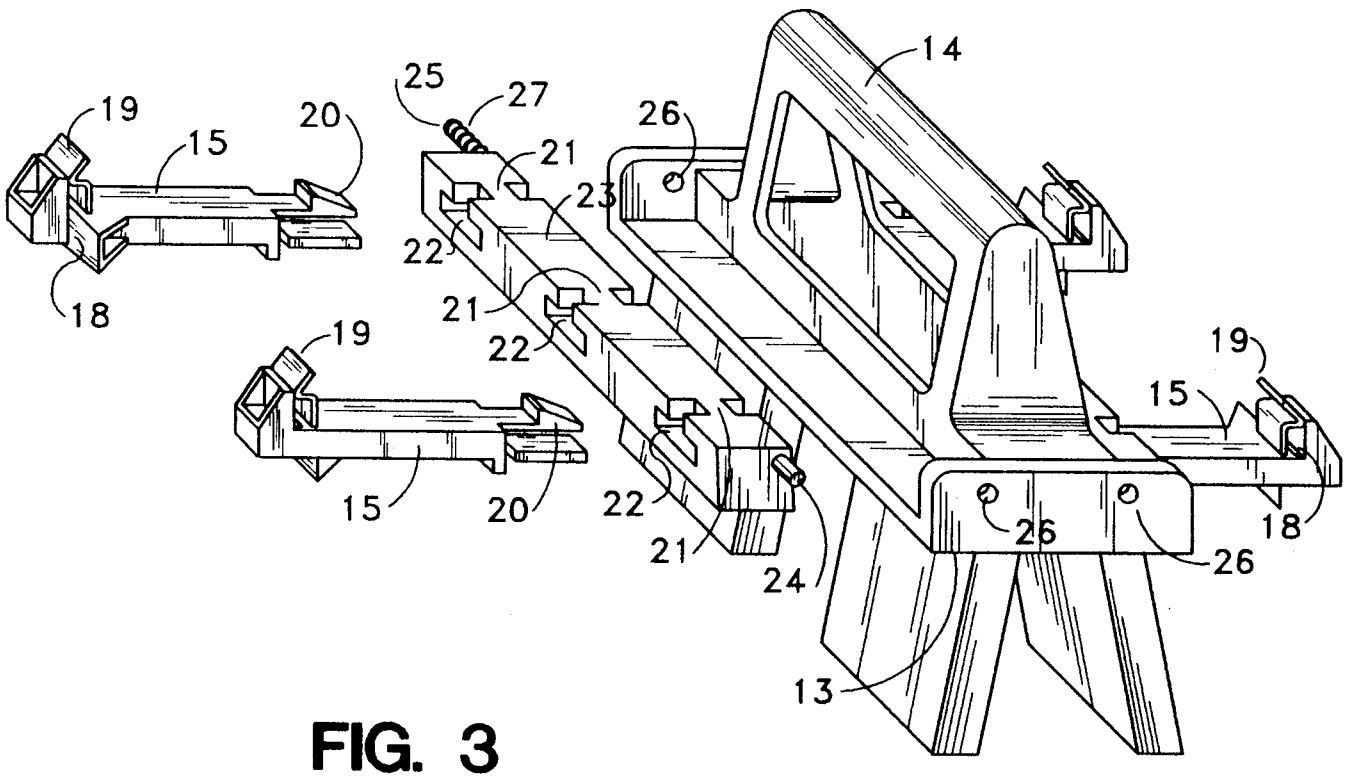
FIG. 3 is an exploded detailed perspective view of the preferred embodiment of applicant's invention.

Referring now more particularly to the drawings, FIG. 1 shows applicant's preferred embodiment of the invention generally at 10 astride the center portion 11 of a typical divided kitchen sink shown generally at 12. In this embodiment of applicant's invention there is a base member 13 preferably provided with a handle 14 and bars 15—15 provided with slots at the end thereof to engage and hold the bag 16. This can be better observed by referring to FIGS. 2 and 3.

In FIG. 2, which is a section on the plane 2—2 of FIG. 1, the bag 16 is shown with its thicker locking portion 17 above a slot 18 located in the arm 15. In this embodiment of the invention, a spring-loaded clamp 19 is shown securely holding the bag 16 in position by pressing the portion of the bag between the open end of the bag 16 and the locking portion 17 thereof against the end 15*a* of the arm 15. The opposite end of the bar 15 is provided with a catch 20 which is flexible and may be pushed downwardly to disengage from the upper side 21 of receptacle 22. This may be better understood by referring to FIG. 3.

It will be seen from an examination of FIG. 3 that bars 15—15 may be inserted in a choice of receptacles 22—22, the spacing of said receptacles 22—22 being chosen to accommodate the various bags available. Obviously, the distance between bars 15—15 is chosen so that when the bag is placed in slots 18—18 and held by clamp 19, the bag would be held with the throat in an open position. The bars 15—15 are positioned in support 23 which is provided with two pins 24 and 25 at opposite ends thereof adapted to engage holes 26—26 in said base member 13. Pin 25 is axially movable and surrounded by spring 27 which in turn is attached to support 23, so that support 23, when pins 25 and 24 engage holes 26—26, is held in position and may be rotated to a new position and held therein by the friction between the end surface of support 23 and the end surface of the base member 13 adjacent the hole 26 which engages pin 24 and spring 27 forcing support 23 toward the portion of the base member 13 adjacent that hole 26.

If desired, means may be incorporated to adjust the tension on spring 27 to increase or decrease the frictional force employed. By rotating the assembly consisting of the two arms 15—15 and support 23, this device can be adjusted to hold different length bags as well as different width bags by placing the bars 15—15 in different combinations of receptacles as shown.

While this invention has been described in its preferred embodiment, it is to be appreciated that variations therefrom may be made without departing from the true scope and spirit of the invention.

What is claimed is:

1. A holder for plastic bags of the type which may be closed by applying pressure to two oppositely disposed locking portions of said plastic bag adjacent the opening of said bag, which comprises:

two oppositely disposed bars, each bar containing a slot therein at one end thereof extending partially across said bar at right angles to the length of said bar, said slot having a width for receiving a double thickness of said plastic bag but said width being smaller than the thickness of said oppositely disposed locking portions of said plastic bag, the other end of each of said bars being affixed to a first support.

2. The holder of claim 1 wherein said first support is fixedly rotatably attached to a second support.

3. The holder of claim 2 wherein means are included to adjust the position of said first support relative to said second support and to maintain said first support in said adjusted position.

4. The holder of claim 1 wherein said bars have clamping means adjacent one end of said slots for clamping said plastic bag and holding said plastic bag in position when inserted in said slot.

5. The holder of claim 4 wherein said clamping means involves means normally biased toward a second means adjacent said slots for clamping said plastic bag and holding said plastic bag in position when inserted in said slot.

6. The holder of claim 1 wherein each of said bars is provided with a catch at the other end of said bar adapted to engage a receptacle positioned in said first support.

7. A holder for plastic bags of the type which may be closed by applying pressure to two oppositely disposed locking portions of said plastic bag adjacent the opening of said bag, which comprises:

a base member, a handle upstanding from said base member, means depending from said base member adapted to engage a vertically extending member, said base member being provided with at least one support, said support being rotatably attached to said base member, said support being provided with a plurality of receptacles therein, two oppositely disposed bars, each bar containing a slot therein at one end thereof extending partially across said bar at right angles to the length of said bar, said slots having a width for receiving a double thickness of said plastic bag but said width being smaller than the thickness of said oppositely disposed locking portions of said plastic bag, the other end of each of said bars being provided with a means adapted to detachedly engage said engage said receptacles in said first support.

8. The holder of claim 7 wherein each of said bars have clamping means adjacent one end of said slots for clamping said plastic bag and holding said plastic bag in position when inserted in said slot.

9. The holder of claim 8 wherein said clamping means involves means normally biased toward a second means adjacent said slots for clamping said plastic bag and holding said plastic bag in position when inserted in said slot.

* * * * *

UNITED STATES PATENT AND TRADEMARK OFFICE

CERTIFICATE OF CORRECTION

PATENT NO. : 5,275,363

DATED : January 4, 1994

INVENTOR(S) : Ralph E. Dennis

It is certified that error appears in the above-indentified patent and that said Letters Patent is hereby corrected as shown below:

Claim 7, column 4, line 3, "means adapted to detachedly engage said engage" should read -- means adapted to detachedly engage --.

Signed and Sealed this

Third Day of May, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,275,363

DATED : January 4, 1994

INVENTOR(S) : Ralph E. Dennis

It is certified that error appears in the above-indentified patent and that said Letters Patent is hereby corrected as shown below:

The title page, showing the illustrative figure, should be deleted and substitute therefor the attached title page.

Figures 1 and 2 should be deleted to be replaced with figures 1 and 2 as shown on the attached sheet.

Signed and Sealed this

Eleventh Day of October, 1994

*Attest:*

Bruce Lehman

BRUCE LEHMAN

*Attesting Officer*

*Commissioner of Patents and Trademarks*

United States Patent [19]

Dennis

[11] Patent Number: 5,275,363

[45] Date of Patent: Jan. 4, 1994

[54] DENNIS BAG HOLDER

[76] Inventor: Ralph E. Dennis, 2617 Fishinger Rd., Columbus, Ohio 43221

[21] Appl. No.: 858,734

[22] Filed: Mar. 27, 1992

[51] Int. Cl.[5] ..... B65B 67/00

[52] U.S. Cl. ..... 248/101; 248/214; 248/312.1; 248/224.3

[58] Field of Search ..... 248/101, 99, 95, 97, 248/224.3, 224.4, 220.4, 312.1, 214; 141/314, 390, 391, 114; 220/630; 383/33, 12

[56] References Cited

U.S. PATENT DOCUMENTS

| | | | |
|---|---|---|---|
| 457,086 | 8/1891 | Ketchum | 248/97 X |
| 1,019,366 | 3/1912 | Sargent | 248/101 |
| 2,235,182 | 3/1941 | Weston | 248/100 |
| 2,483,844 | 10/1949 | Ranseen | 248/99 |
| 2,903,215 | 9/1959 | Metcalf | 248/99 |
| 4,478,332 | 10/1984 | Wiestmiller | 383/12 X |
| 4,768,742 | 9/1988 | Kaaloa | 248/100 X |
| 4,838,504 | 6/1989 | Bittenbinder | 248/100 |
| 4,974,798 | 12/1990 | Harding et al. | 248/224.3 X |
| 4,979,706 | 12/1990 | Feldman et al. | 248/101 |

*Primary Examiner*—Karen J. Chotkowski
*Attorney, Agent, or Firm*—John L. Gray

[57] ABSTRACT

Applicant's invention provides a bag holder which enables a ZIPLOC® type of bag to be held in open position while filling and is adaptable to various sizes of these bags and which invention can be readily used by a single individual.

9 Claims, 2 Drawing Sheets

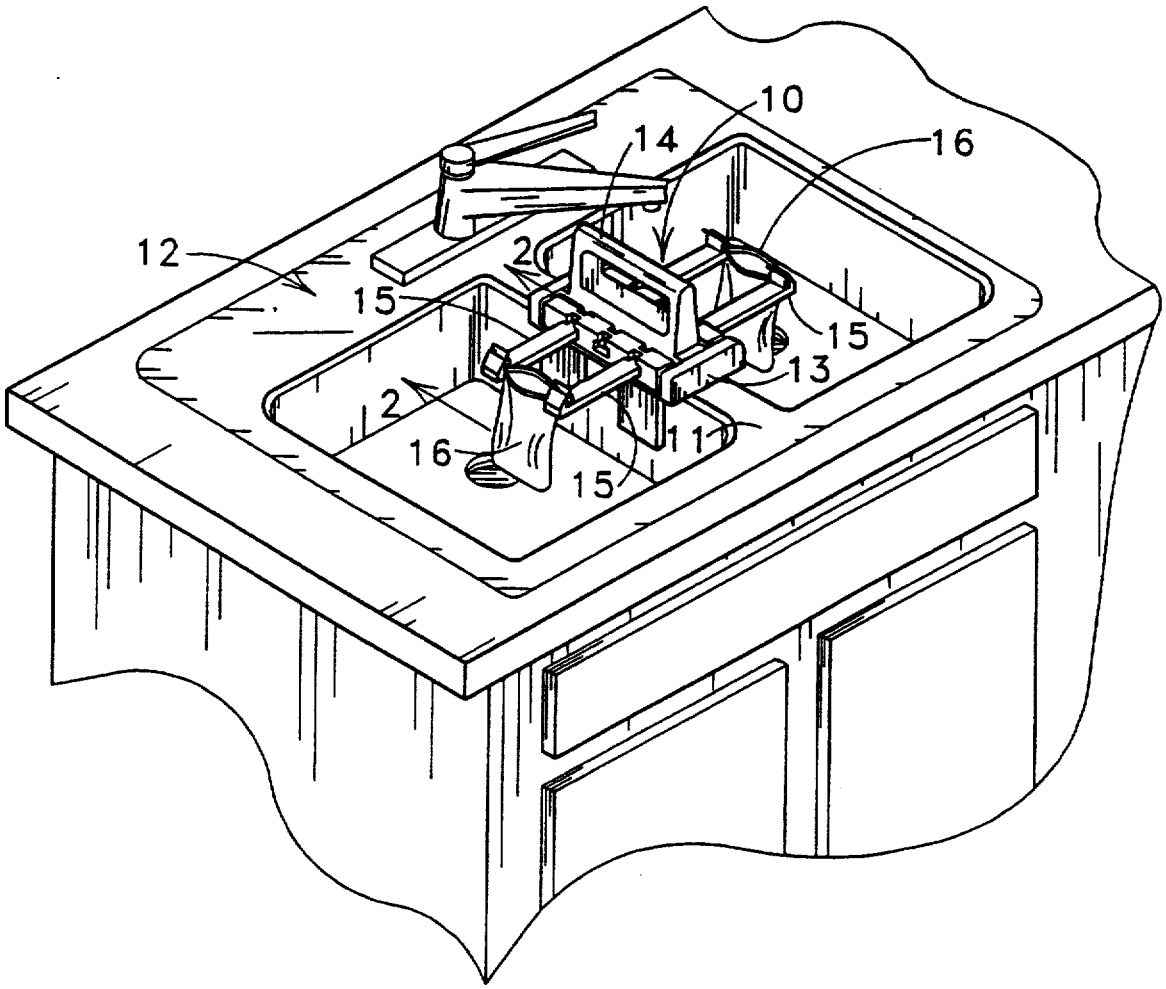

FIG. 1
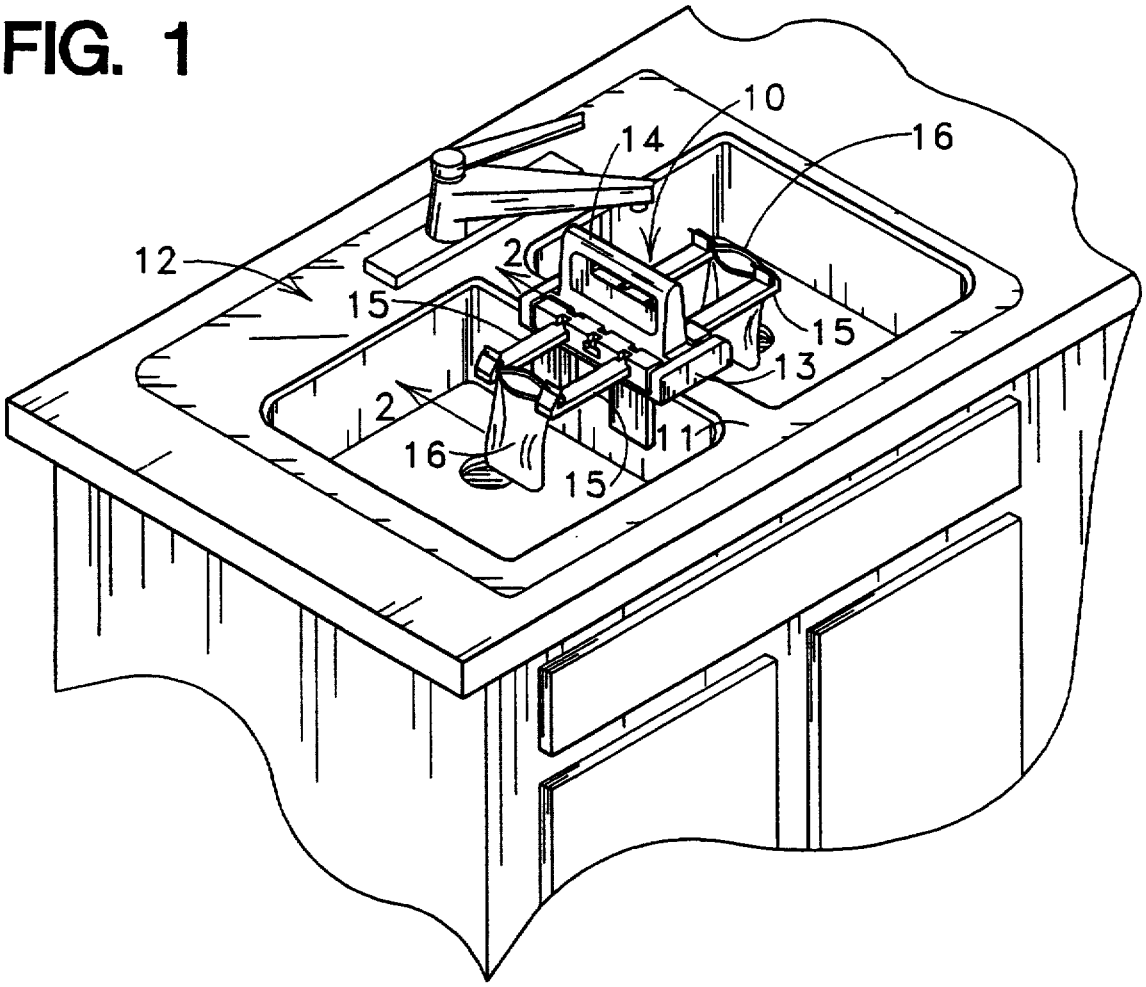
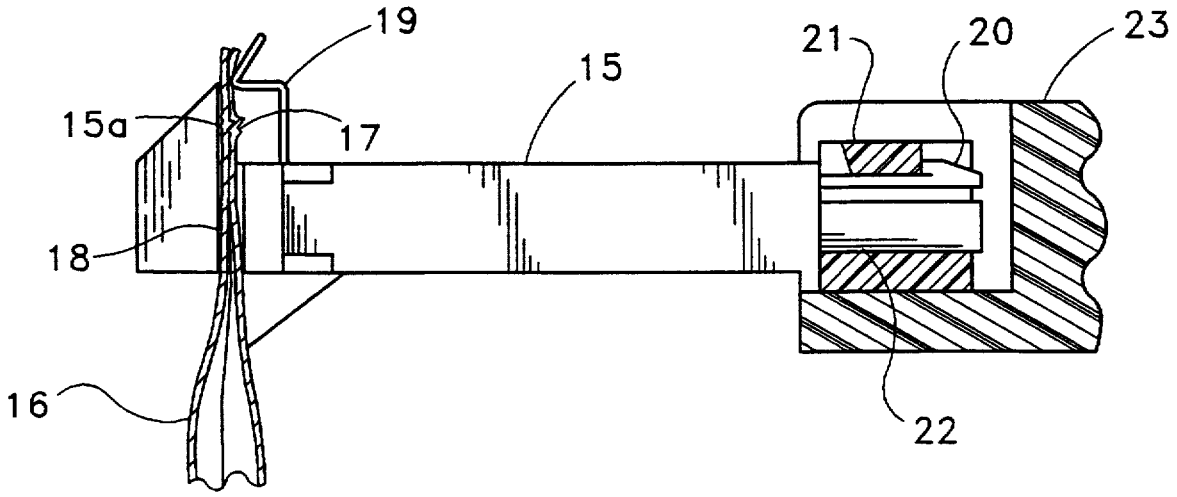
FIG. 2